US009334095B2

(12) United States Patent
Mattiucci

(10) Patent No.: US 9,334,095 B2
(45) Date of Patent: May 10, 2016

(54) I-BEAM STAND ALONE PACKAGE

(71) Applicant: CardPak, Inc., Solon, OH (US)

(72) Inventor: James Joseph Mattiucci, Wakefield, RI (US)

(73) Assignee: CARDPAK, INC., Solon, OH (US)

( * ) Notice: Subject to any disclaimer, the term of this patent is extended or adjusted under 35 U.S.C. 154(b) by 144 days.

(21) Appl. No.: 14/173,162

(22) Filed: Feb. 5, 2014

(65) Prior Publication Data

US 2014/0216970 A1 Aug. 7, 2014

Related U.S. Application Data

(60) Provisional application No. 61/761,390, filed on Feb. 6, 2013.

(51) Int. Cl.
*B65D 5/52* (2006.01)
*B65D 73/00* (2006.01)
*B65D 75/36* (2006.01)

(52) U.S. Cl.
CPC ..... *B65D 73/0092* (2013.01); *B65D 75/36* (2013.01); *B65D 2207/00* (2013.01)

(58) Field of Classification Search
USPC ..... 206/775
See application file for complete search history.

(56) References Cited

U.S. PATENT DOCUMENTS

| | | | | | |
|---|---|---|---|---|---|
| 3,399,763 | A * | 9/1968 | Stone | B65D 73/0057 | 206/462 |
| 3,407,928 | A * | 10/1968 | Watts, Jr. | B65D 73/0092 | 206/45.24 |
| 3,587,848 | A * | 6/1971 | Froehlig | B65D 75/52 | 206/462 |
| 3,685,649 | A * | 8/1972 | Diehl | B65D 73/0092 | 206/45.24 |
| 3,912,079 | A * | 10/1975 | Selchow, Jr. | B65D 73/0092 | 206/463 |
| 8,684,182 | B2 * | 4/2014 | Bailey | B65D 73/0092 | 206/45.24 |
| 2010/0084300 | A1 * | 4/2010 | Hession | B65D 73/0092 | 206/462 |
| 2012/0061290 | A1 * | 3/2012 | Delaunay | B65D 5/5019 | 206/769 |

* cited by examiner

*Primary Examiner* — Jacob K Ackun
(74) *Attorney, Agent, or Firm* — Pearne & Gordon LLP

(57) ABSTRACT

The present invention generally relates to a package which allows a product to be displayed and retains structural integrity so that it can stand independently on a shelf or reside in a low sidewall display tray. In one embodiment, the package of the present invention can stand alone independently on an integrated cardboard base. In another embodiment, the package of the present invention can use the integrated cardboard base in conjunction with a low profile display tray.

13 Claims, 8 Drawing Sheets

I-BEAM STAND ALONE PACKAGE

RELATED APPLICATIONS

This application claims priority to and is a non-provisional of U.S. Provisional Patent Application No. 61/761,390 filed Feb. 6, 2013, entitled "I-Beam Stand Alone Package," the contents of which is incorporated by reference.

FIELD OF THE INVENTION

The present invention generally relates to a package which allows a product to be displayed and retains structural integrity so that it can stand independently on a shelf or reside in a low sidewall display tray. In one embodiment, the package of the present invention can stand alone independently on an integrated cardboard base. In another embodiment, the package of the present invention can use the integrated cardboard base in conjunction with a low profile display tray.

BACKGROUND OF INVENTION

Blister or clam shell packages have long been used for packaging a wide variety of products and for displaying these products for sale in retail stores. The package is typically designed to conform to the configuration of the article contained therein. Such blisters/clam-shells, after filling, are bonded to supporting paper cards and can either be hung from a rack or if a stand-up type mechanism is utilized can be displayed on a shelf or table. Another display method involves the use of low profile display trays. Such a setup is currently popular in warehouse stores like Costco and Sam's Club. Current stand up displays pose structural problems as their flat nature does not allow the product to stand independently or requires a firm or large display tray.

In recent years, the number and variety of products packaged and displayed in blister-type and clam shell type packaging has increased. Part of this increase is due to the popularity of warehouse shopping centers. Such blister and clamshell packages have found wide use in retail stores and warehouse centers as they display each item and also protect the product inside from tampering. As such, the displays should be pilfer-resistant, meaning one cannot easily shoplift, or steal, the product contained therein without first removing the item from the package or in the alternate by shoplifting the entire bulky package.

The hanging display, once predominantly used in the industry, has yielded portions of the market to alternative types of displays. The proliferation of warehouse stores/centers has required the use of a variety of standup displays. Typically, the standup or standalone display requires a larger amount of cardboard or paperboard than a flat or hanging display. This can be overcome with the use of display trays, but again the use of cardboard increases and the tray itself adds additional cost to the product.

One advantage the present invention has over this prior art involves the ability of the package to stand independently with a pleasingly aesthetic graphical display. In the prior art, heavier products may cause the package to tip or may require additional cardboard to stabilize. The present invention would allow the package retailer additional options in this regard, as options with the present invention's base would allow for a stand-alone package or would allow for smaller or lower profile display trays.

In recent years, several major warehouse centers and retail outlets have undertaken environmentally friendly and/or green programs regarding recycling. These programs promote the use of environmentally friendly packaging and necessitates the need for environmentally friendly packaging designs. Thus, there is a need in the art for a package that not only has the ability stand independently, but also one that is more readily recycled.

SUMMARY OF INVENTION

The present invention generally relates to a package which allows a product to be displayed and retains structural integrity so that it can stand independently on a shelf or reside in a low sidewall display tray. In one embodiment, the package of the present invention can stand alone independently on an integrated cardboard base. In another embodiment, the package of the present invention can use the integrated cardboard base in conjunction with a low profile display tray.

In one embodiment the present invention discloses a package with structural integrity to stand independently comprising a front, a back, one or more sides, a space between the front, back and one or more sides to hold product, and wherein the front, the back, and the one or more sides together form a package having a base made from the same material as the front or back, wherein the base permits the package to stand independently.

In another embodiment the present invention discloses a package with structural integrity to stand in a low profile display tray comprising, a front, a back, one or more sides, a space between the front, back and one or more sides to hold product, and wherein the front, the back, and the one or more sides together form a package having a base made from the same material as the front or back, wherein the base permits the package to stand independently.

In still yet another embodiment the present invention discloses a method for forming a package with structural integrity to stand independently comprising providing a front, providing a back, providing a one or more sides, providing a space between the front, back and one or more sides to hold product, and securing the front, the back, and the one or more sides together form a package having a base made from the same material as the front or back, wherein the base permits the package to stand independently.

DETAILED DESCRIPTION OF THE INVENTION

Figure 1:
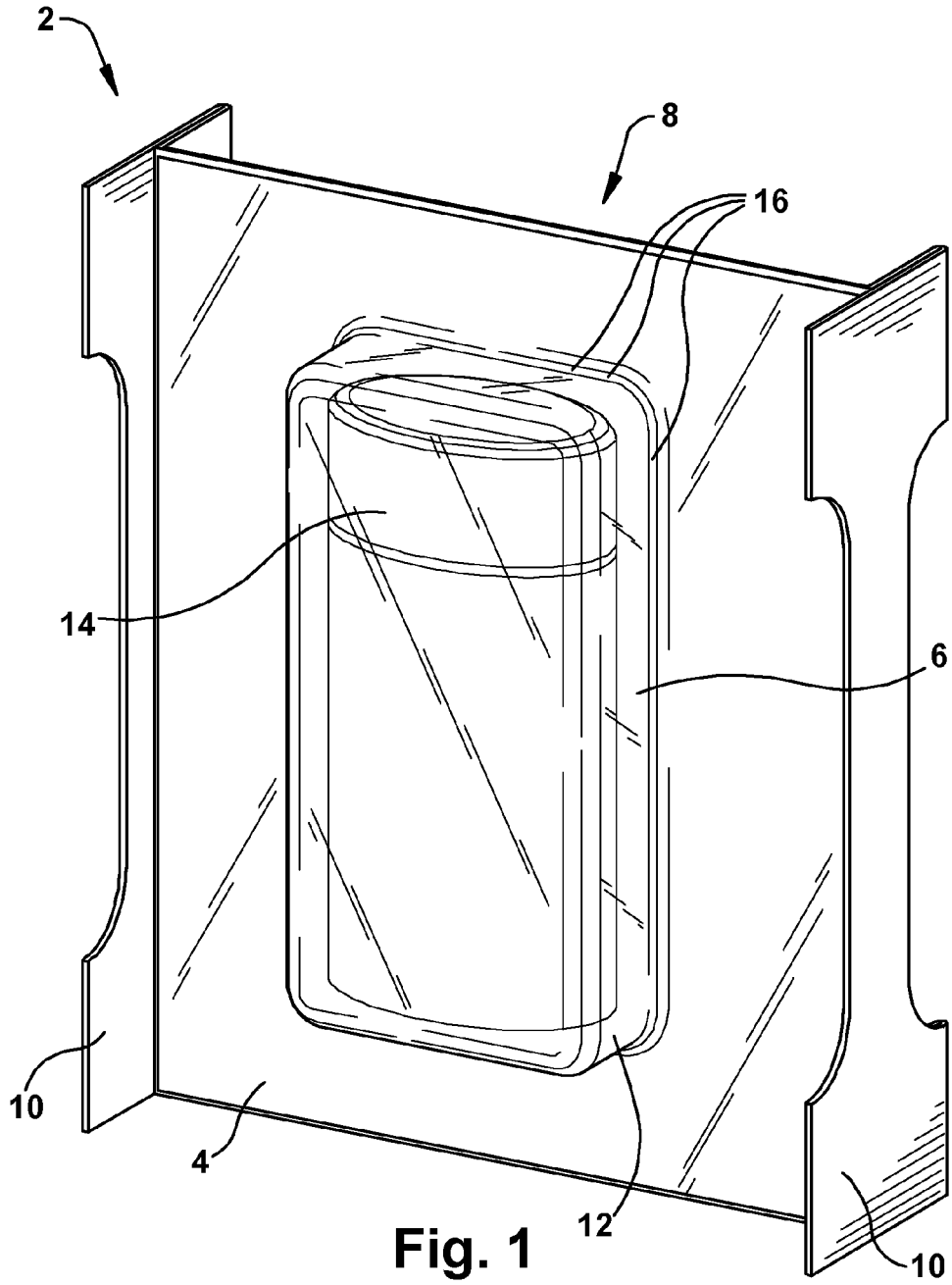
FIG. 1 is a drawing of a front view of the package with a blister insert, non-locking sides and an additional card front.

In one embodiment the present invention discloses a package with structural integrity to stand independently comprising a front, a back, one or more sides, a space between the front, back and one or more sides to hold product, and wherein the front, the back, and the one or more sides together form a package having a base made from the same material as the front or back, wherein the base permits the package to stand independently.

In another embodiment the present invention discloses a package with structural integrity to stand in a low profile display tray comprising, a front, a back, one or more sides, a space between the front, back and one or more sides to hold product, and wherein the front, the back, and the one or more sides together form a package having a base made from the same material as the front or back, wherein the base permits the package to stand independently.

In still yet another embodiment the present invention discloses a method for forming a package with structural integrity to stand independently comprising providing a front, providing a back, providing a one or more sides, providing a space between the front, back and one or more sides to hold product, and securing the front, the back, and the one or more sides together form a package having a base made from the same material as the front or back, wherein the base permits the package to stand independently.

The present invention generally relates to a package which allows a product to be displayed and retains structural integrity so that it can stand independently on a shelf or reside in a low sidewall display tray. In one embodiment, the package of the present invention can stand alone independently on an integrated cardboard base. In another embodiment, the package of the present invention can use the integrated cardboard base in conjunction with a low profile display tray.

As used in the specification and claims, de-constructable is defined as a package that can be separated into suitable paper and plastic portions and then optionally be recycled via normal waste collection means. Recyclable is defined as a package recycled via normal waste collection means. Clamshell is a type of packaging design that is known to those of skill in the art. Blister is a type of packaging design that is known to those of skill in the art. As used in conjunction with the present invention, suitable paper-based materials include, but are not limited to, paper, cardboard, cardstock, fluted card stock, fluted cardboard, corrugated card stock, fluted cardboard or any other product formed using paper/wood product as the starting material. Plastic or plastic-based materials suitable for use in conjunction with the present invention include, but are not limited to, products made from polymers. Examples of suitable plastic polymers include, but are not limited to, polypropylenes (PP), polystyrenes (PS), high impact polystyrenes (HIPS), polyethylene terephthalates (PET), poly(vinyl chlorides) (PVC), polyurethanes (PU), polycarbonates (PC), polyvinylidene chlorides (PVDC) and polyethylenes (PE). Due to the nature of product display, most embodiments will employ, but are not limited to, a transparent or translucent plastic.

An additional stiffening card can be employed via the use of corrugated plastic, or even paper-based, insert. In one embodiment, a corrugated plastic insert is included in addition the plastic shell or inner portion. In another embodiment, the profile or the blister flange itself is corrugated. This corrugated plastic allows for a substantially stiffer package and improves tamper resistance, appearance and stability. A similar corrugated paper-based insert may be used as well.

Figure 2:
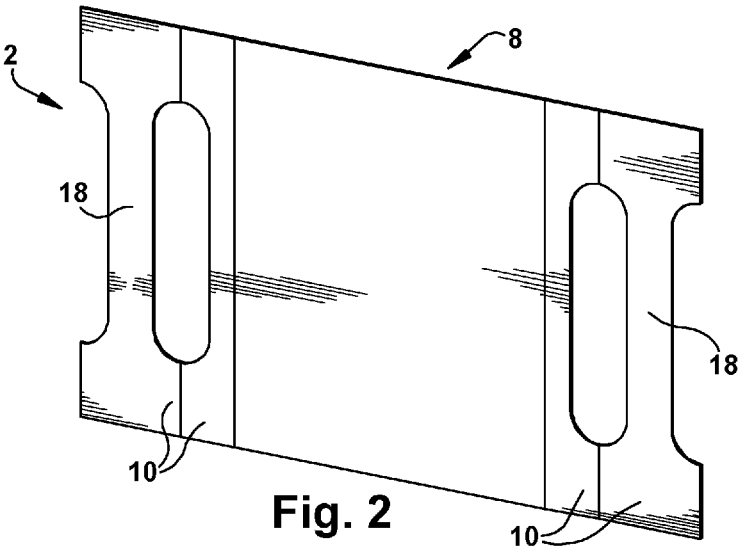
FIG. 2 is a drawing of the card used to create one embodiment of the package with non-locking tabs.
Figure 3:
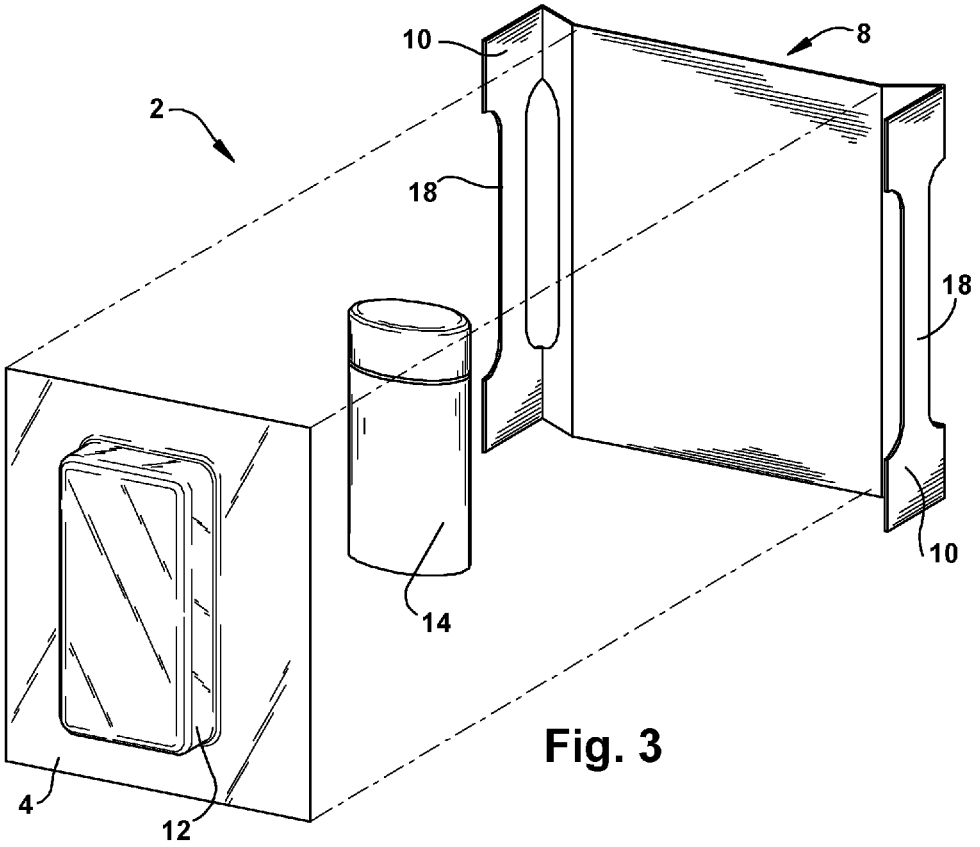
FIG. 3 is an extrapolated drawing of a front view of the package with a blister insert, non-locking sides and an additional card front.
Figure 4:
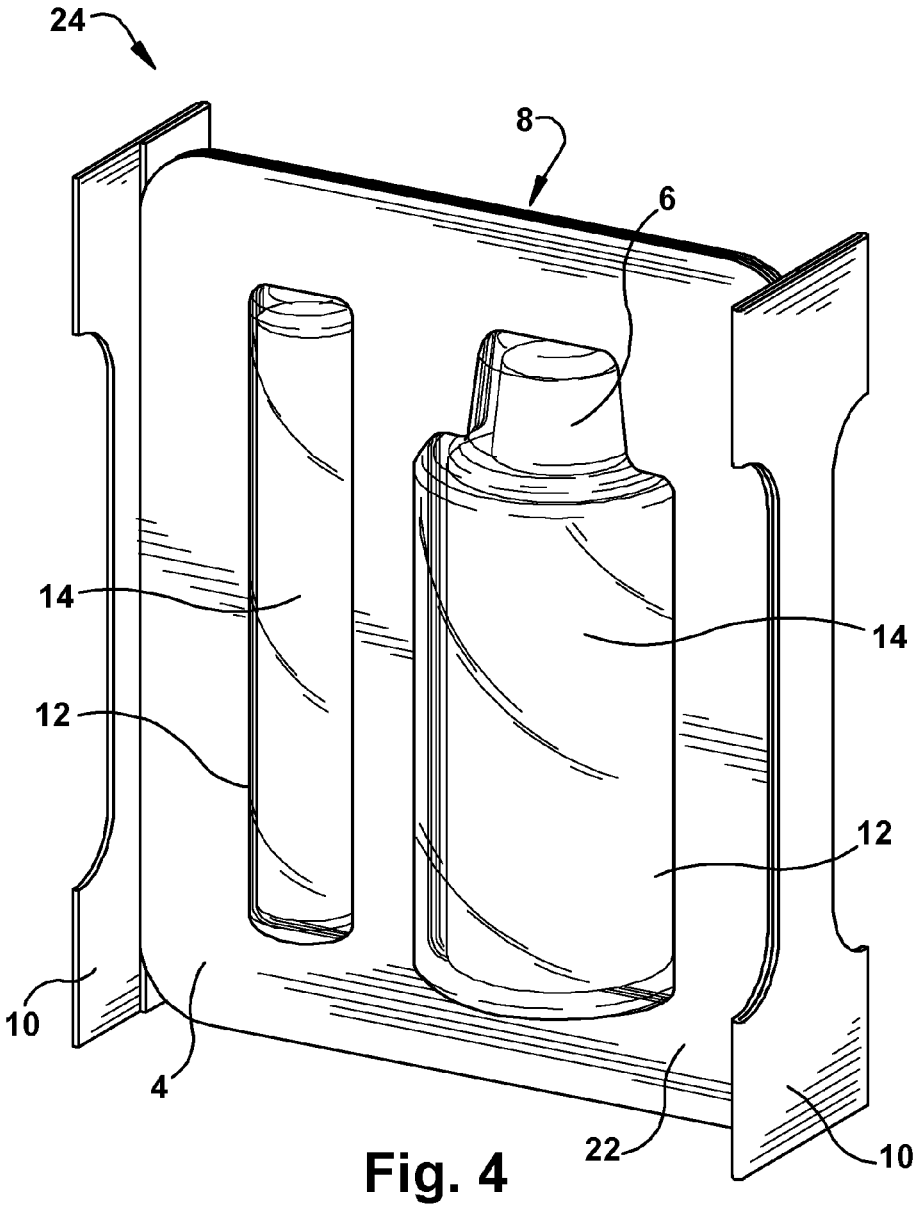
FIG. 4 is a drawing of a front view of the package with a blister insert, and an attached card front.
Figure 5:
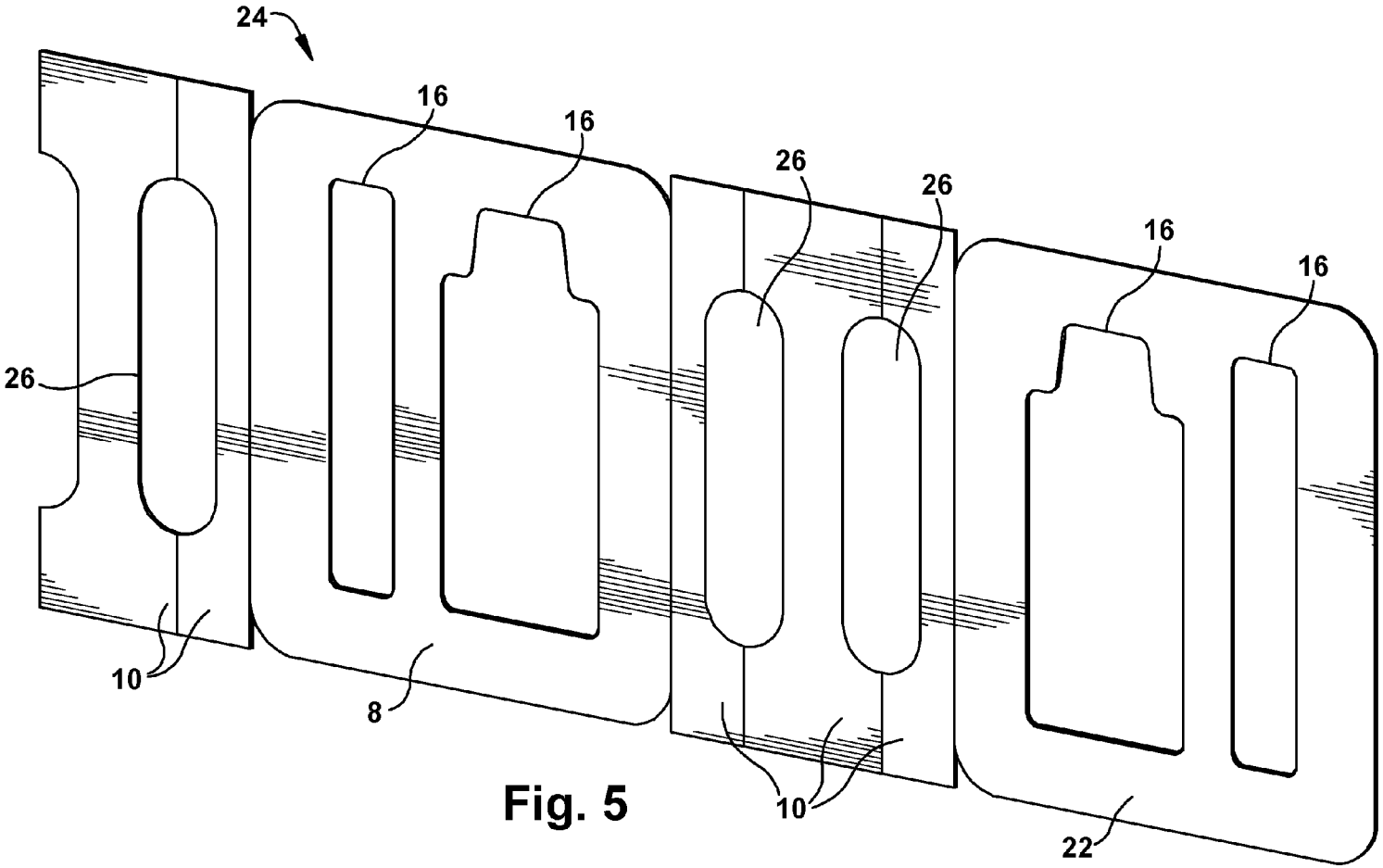
FIG. 5 is a drawing of the card used to create one embodiment of the package with non-locking tabs and an attached card front.
Figure 6:
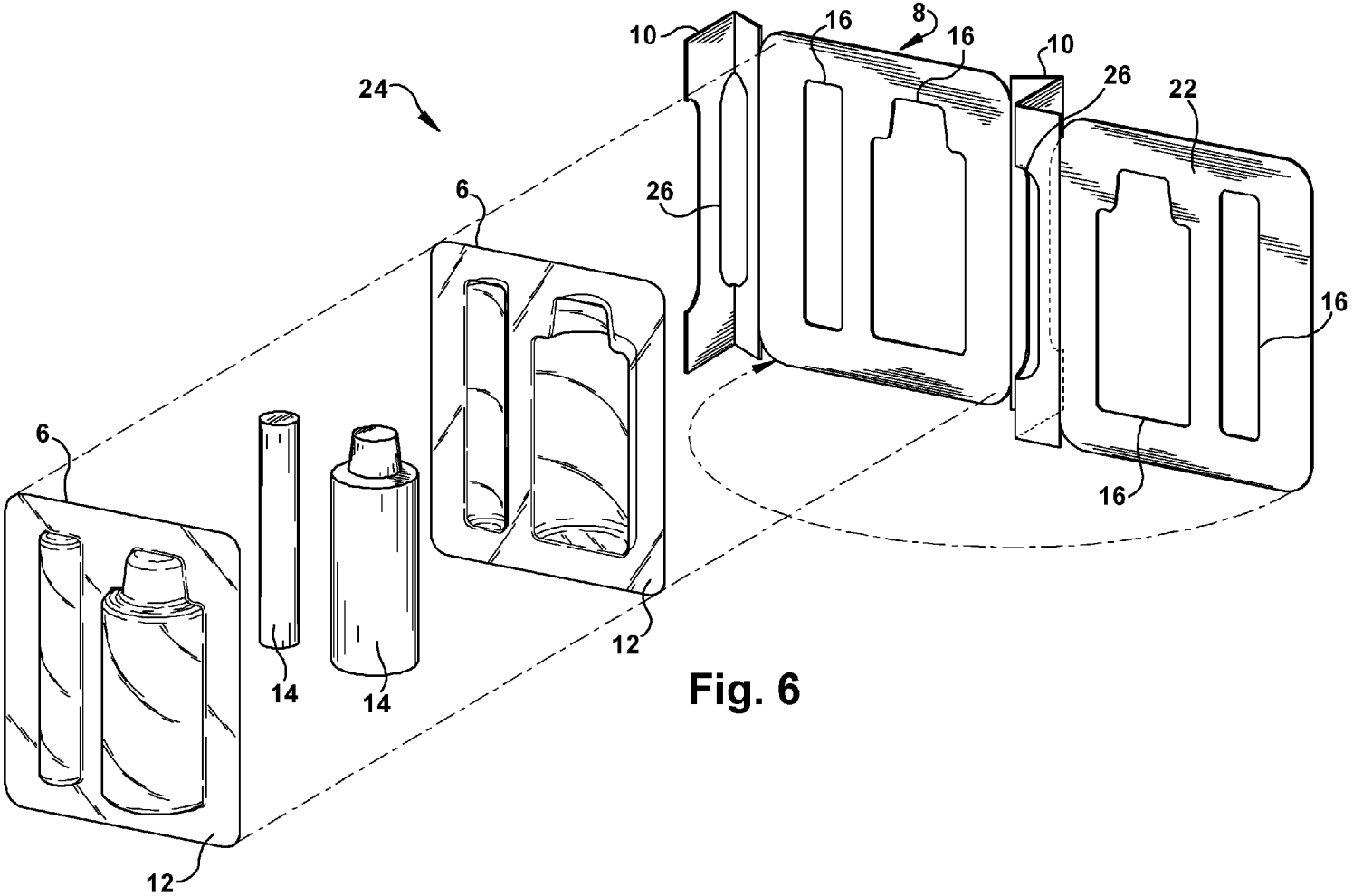
FIG. 6 is an extrapolated drawing of a front view of the package with a blister insert, and an attached card front.
Figure 7:
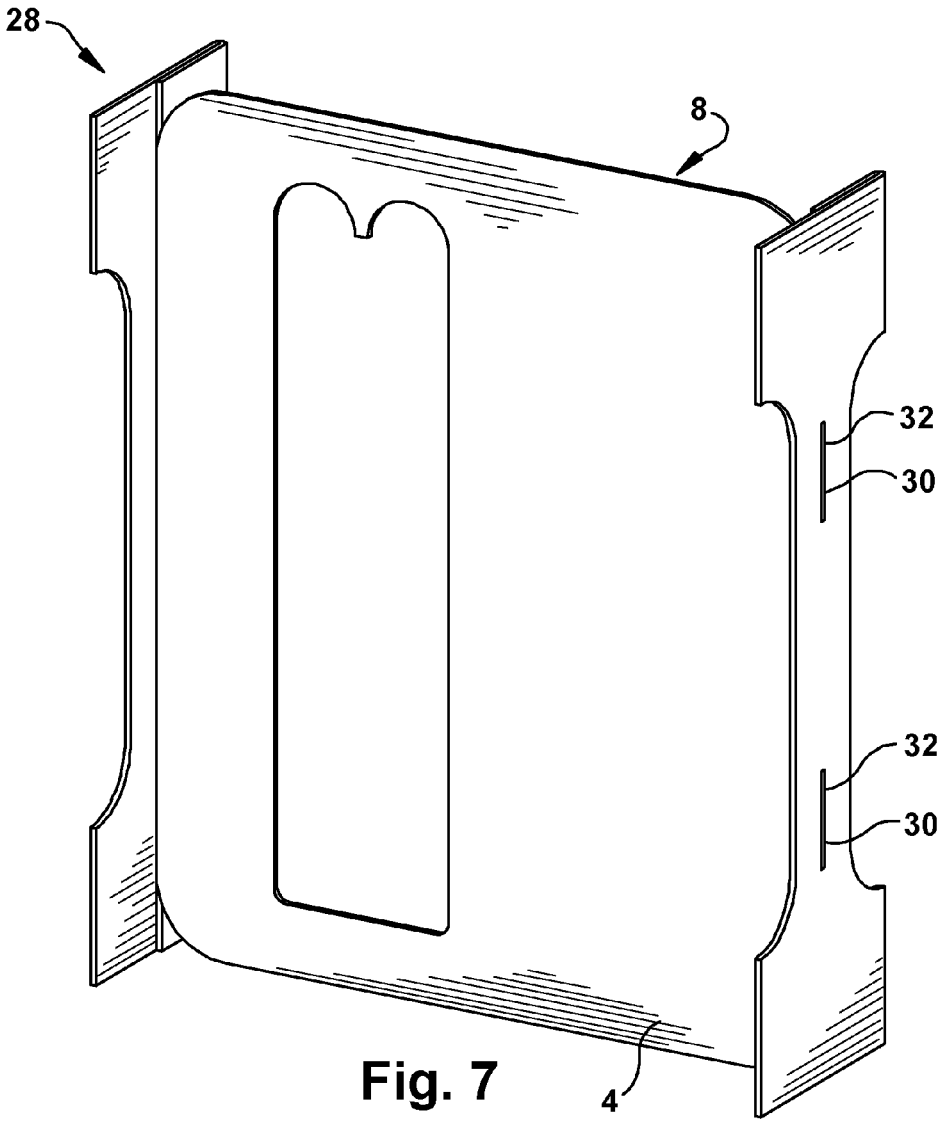
FIG. 7 is a drawing of a front view of the package with an opening for an insert, and locking tabs.
Figure 8:
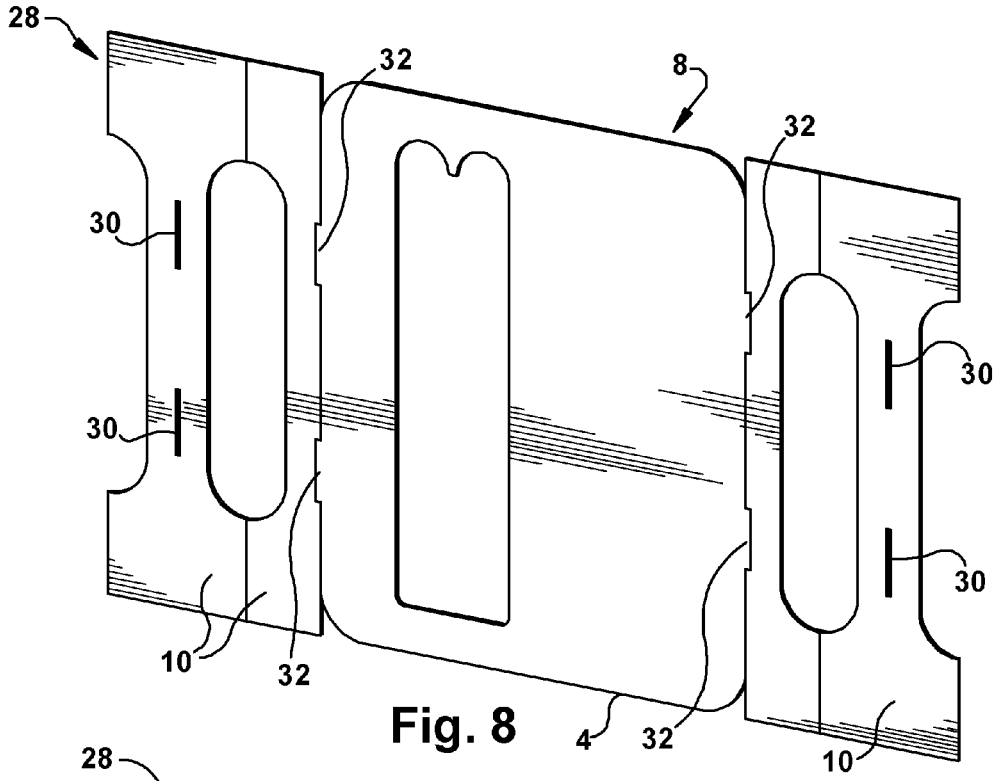
FIG. 8 is a drawing of the card used to create one embodiment of the package with an opening for an insert, and locking tabs.
Figure 9:
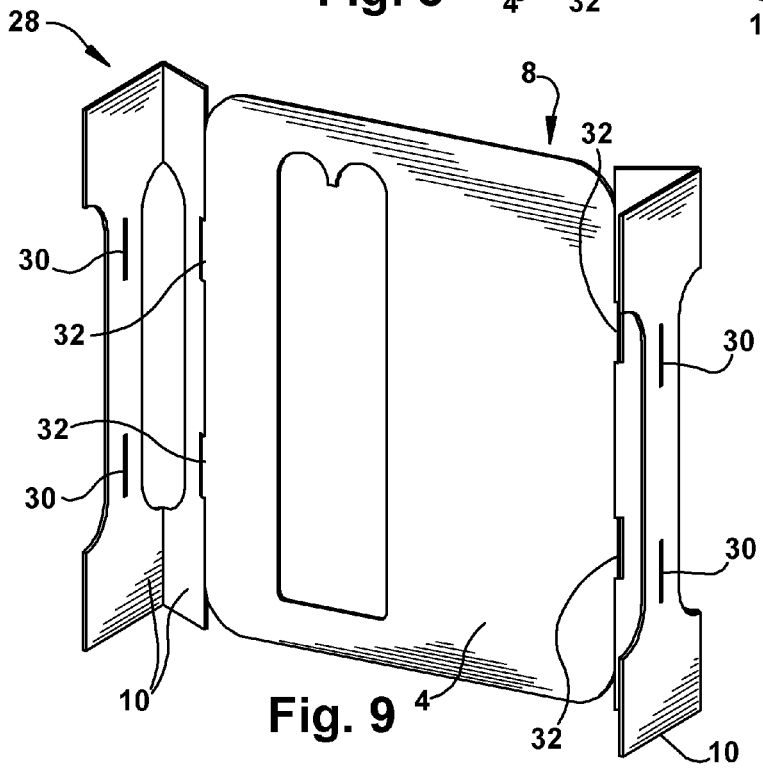
FIG. 9 is an alternate drawing of a front view of the package being assembled with an opening for an insert, and locking tabs.
Figure 10:
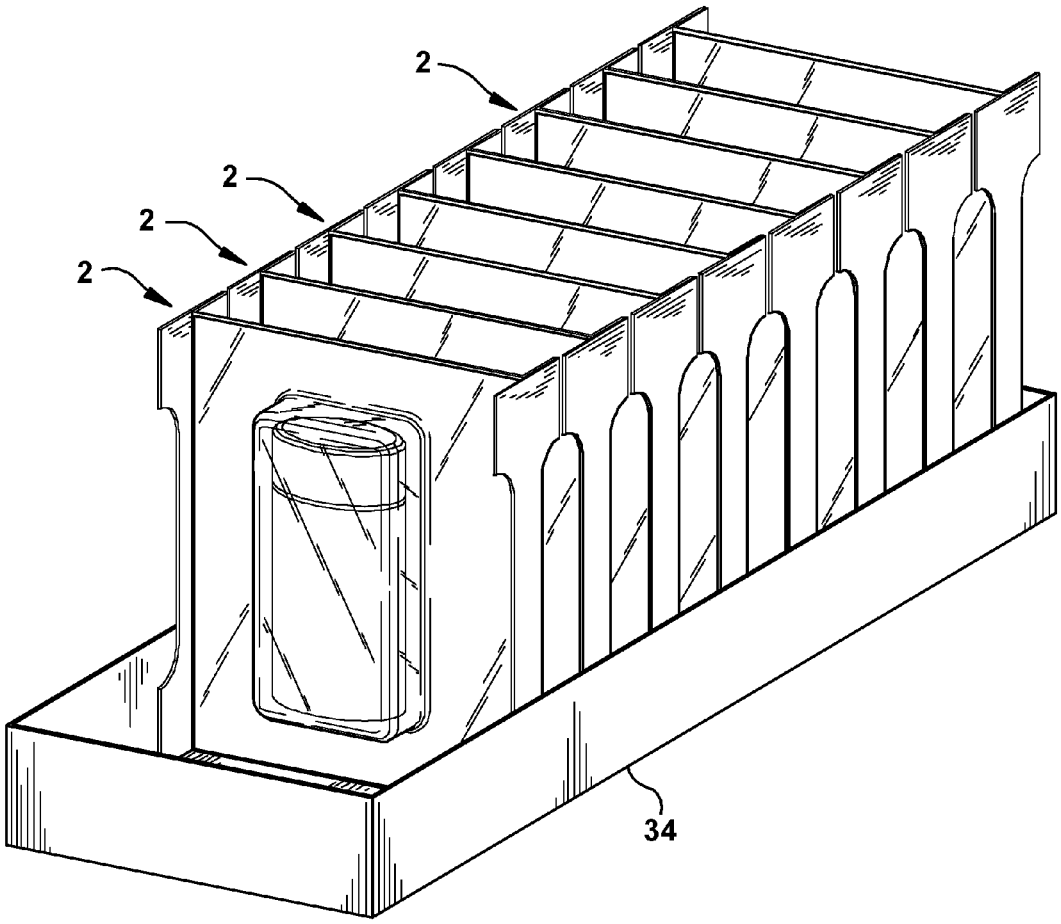
FIG. 10 is a drawing showing the package in a display tray.

Examples of several embodiments of the present invention are detailed in FIGS. 1 through 10. FIG. 1 details a drawing of a front view of the package with a blister insert, non-locking sides and an additional card front. (In most embodiments, a blister insert or clamshell insert can be used interchangeably.) FIG. 2 details a drawing of the card used to create one embodiment of the package with non-locking tabs. FIG. 3 details an extrapolated drawing of a front view of the package with a blister insert, and an additional card front. FIG. 4 details a drawing of a front view of the package with a blister insert, and an attached card front. FIG. 5 details a drawing of the card used to create one embodiment of the package with non-locking tabs and an attached card front. FIG. 6 details an extrapolated drawing of a front view of the package with a blister insert, and an attached card front. FIG. 7 details a drawing of a front view of the package with an opening for an insert, and locking tabs. FIG. 8 details a drawing of the card used to create one embodiment of the package with an opening for an insert, and locking tabs. FIG. 9 details an alternate drawing of a front view of the package being assembled with an opening for an insert, and locking tabs. FIG. 10 is a drawing showing the package in a display tray.

In one embodiment, package 2 is comprised of front 4, middle 6, and back 8 with one or more sides 10. In one embodiment, front, back and one or more sides are formed from a paper-based material, while middle is formed from a plastic-based material. As can be seen from FIG. 1, front 4 and one or more sides 10 are configured to allow package 2 to stand independently. FIG. 1 also details middle 6. In this embodiment middle includes one or more blisters 12, which encloses product 14. Blisters 12 typically being made from plastic. In one embodiment, middle 6 forming one or more chambers or receptacles for one or more products to be displayed. Middle 6 typically containing one or more product portions that are formed to conform to and/or hold any suitable number of objects. In the embodiment shown in FIG. 1, blister 12 being secured between front 4 and back 8. Front 4 being a separate piece which adheres directly to back 8 via an adhering means. Adhering means typically being, but not limited to, glue. Other adhering means being adhesive, heat activated adhesive, pressure activated adhesive, releaseable adhesive, or pressure.

Regarding front, in one embodiment front 4 has formed therein at least one opening 16 that is designed to permit, if so desired, a portion, or portions, of middle 6 to protrude there through. In this case, middle can also be referred to as an insert in package because middle can be "inserted" between front and back. In still another embodiment, back has formed therein at least one opening that is designed to permit, if so desired, a portion, or portions, of middle to protrude there through. In still yet another embodiment the opening allowing insert to protrude through front, back or both openings. In yet another embodiment, middle portion adhering directly onto front. In addition, one or more sides 10 is configured to allow package to stand independently or with the aid of low profile display trays.

FIG. 1 provides a setup where an embodiment may include front 4 being made from a sheet of paperboard and back 8 manufactured from corrugated cardboard. In an alternative embodiment, front 4 and back 8 can be swapped. In both embodiments, one or more sides 10 is made from corrugated cardboard.

Typically, the material chosen for middle 6 permits a user to visually observe product 14 contained therein. Accordingly, in one embodiment if visibility is desirable middle 6 is formed from a clear plastic, or plastic-based, material. However, middle of the present invention does not always need to be formed from a translucent, clear, or optically clear plastic material. In addition, the plastic used is of an adequate thickness to prevent tampering and/or pilfering of product. It is understood, that the particular design of product portions depends upon the contents destined to be contained, or cradled therein. In one embodiment, the product portions conforming to the product shape so as to minimize movement of the product within package and specifically within product portion. FIG. 2 provides a flat drawing of the card used to create the embodiment of package 2 with non-locking tabs and further detailing how package 2 can be formed by one continuous piece of material.

FIGS. 1 and 3 also detail front 4. In one embodiment front 4 may be decorative and used as a way of advertising, or providing information about, the product contained therein. This concept is not limited to any one single advertising embodiment as an unlimited number of embodiments are possible to produce any number of packaging designs. In alternative embodiments, front can be made from any of the paper-based materials detailed above. In one embodiment, front is formed from paper, cardboard, or even a plastic or plastic-based material. In still another embodiment, the paper-based materials used in the packaging of the present invention contain at least some amount of recycled paper material. FIGS. 1, 2 and 3 also detail one or more sides 10 which may also be decorative and used as a way of advertising, or providing information about, product 14 contained therein. Not shown in FIGS. 1, 2 and 3 are alternative views of back 8 which may be decorative and used as a way of advertising, or providing information about, the product contained therein. Graphics or decorations may be found on either side of back 8 so as to be observed from behind package 2 or thru middle 6. Conversely graphics or decorations may be found on either side of front 4 so as to be observed from in front of package 2 or thru middle 6. Graphics may also be found on one or more sides 10.

Additionally, front (or back) can be made from a material which seals to one or more corrugated sheets on at least one side (i.e. card front can be made from several layers of cardstock, with an advertisement typically being on the outermost or top layer). The non-advertisement containing side is typically used for sealing and is, in this example, the back (or second surface) of front. Front may contain one or more optional holes or voids at or near the top of the package to allow the package to be hung from a display.

FIG. 3 provides an extrapolated drawing of a front view of package 2 with a blister insert 12, non-locking sides 18, an additional card front 4, back 8 and all enclosing product 14. In this embodiment, front 4 adheres directly to back 8. In one embodiment non locking sides 18 securing to themselves via an adhering means. In another embodiment, non-locking sides 18 able to fold in a manner to allow product 2 to stand without adhering means or by having non locking sides 18 folded and held in place by a display tray.

In another embodiment, one or more sides 10 designed to protrude at angles from front/back in order to allow a package to stand independently or with the aid of a low profile display tray. In still yet another embodiment, one or more sides 10 designed to protrude at approximately 90-degree angles to front/back.

FIG. 4 provides a drawing of the front view of another embodiment of package 24 with one or more blister 12, and an attached card front 22. In one embodiment, package 24 is comprised of front 4 (with front 4 further comprising attached front 22) middle 6, and back 8 with one or more sides 10. In one embodiment, attached card front 22, back 8 and one or more sides 10 are formed from a continuous piece of paper-based material, while middle is formed from a plastic-based material. As can be seen from FIG. 4, front 4 and one or more sides 10 are configured to allow package 24 to stand independently. In this embodiment middle 6 includes one or more blisters 12, which encloses product 14. One or more blisters 12 typically being made from plastic. In one embodiment, middle 6 forming one or more chambers or receptacles for one or more products to be displayed. Middle 6 typically containing one or more product portions that are formed to conform to and/or hold any suitable number of objects. In the embodiment shown in FIG. 4, one or more blisters 12 being secured between front 4 and back 8. Front 4 being a separate piece which adheres directly to back 8 via an adhering means. Adhering means typically being, but not limited to, glue. FIG. 4 further provides an embodiment where attached card front 22 is directly adhered to back 8 via a securing means. In another embodiment securing attached card front 22 to back 8 further enclosing product 14 inside one or more blisters 12.

FIG. 5 providing a flat drawing of the card used to create the embodiment of package 24 with non-locking tabs and an attached card front and further detailing how package 24 can be formed by one continuous piece of material. Here side 10 is attached to and directly adjacent to back 8, which is attached to and directly adjacent to side 10 which is attached to and directly adjacent to attached card front 22. Opening(s) 16 are shown which optionally allow for the addition of middle 6. Also shown in FIG. 5 are I-cutouts 26 which help form the one or more sides and in embodiment provide for a "I" shaped side 10.

FIG. 6 provides an extrapolated drawing of a front view of package 24 with one or more blisters 12, and attached card front 22. FIG. 6 further showing how the flat card provided in FIG. 5 is assembled into the package shown in FIG. 4. Here sides 10 are folded in a manner which permits attached card front 22 to come into direct contact with back 8 and in doing so securing middle 6 and/or blisters 12. Sides 10 folding in such a manner to form, in this embodiment, an "I". Alternatively back 8 not having opening 16 and provided a solid surface.

In one embodiment the materials used throughout are all corrugated paperboard. In another embodiment, this setup may utilize some level of corrugated plastic content. This setup is similar to the embodiments used in FIGS. 1, 2 and 3 above as a cutout is provided for various configurations described previous. This double corrugated setup typically being described internally as HD2. In one embodiment the one or more sides 10 utilize corrugated cardboard as a configuration for supporting package. In one embodiment, the one or more sides providing an amble base so that package can stand independent and support the weight of the product held within the package. In another embodiment, one or more sides being designed to fit within a low profile display tray. Any number of adhesion means can be utilized by the package in order to secure front to back and to also properly secure middle or blister insert(s).

FIG. 7 details a drawing of the front view of one embodiment of the package with locking tabs. In this embodiment, package 28 utilizes one or more locking tabs to better secure the one or more sides 10 so that they stay secured at the angle desired to front/back. In this embodiment, locking tabs are a two component part including female locking slot 30 and male locking tab 32. Female locking slot 30 typically being a void space or cutout portion of side 10. Male locking tab 32 being formed from a portion attached to back 8. This embodiment further stabilizes package ability to stand independently or to reside within a display tray. Any number of locking tabs are possible. FIG. 7 provides two locking tabs per side, however one, two, three, four or even more tabs per side can be utilized. FIG. 8 utilizes a flat view of the card for package 28 to demonstrate how such an assembly is arranged from a single sheet of corrugated. In this embodiment, a single sheet of corrugated comprising the front 4, back 8 and one or more sides 10. FIG. 9 further showing how the flat card provided in FIG. 8 is assembled into the package shown in FIG. 7. In most embodiments, FIGS. 7, 8 and 9, further utilizing a middle. In that arrangement the middle typically including a blister secured in between front 4 and back 8. Alternatively middle being secured directly onto either front 4 or back 8.

In one embodiment involving package 28, one or more sides 10 is formed from the same piece of material as back 8 and front 4. In this embodiment back, front, one or more sides are manufactured from one single, continuous piece of material. In yet another embodiment one or more sides is formed from the same piece of material as front. In this embodiment front, and one or more sides are manufactured from one single, continuous piece of material and subsequently adhered to back. In this embodiment a separate card is utilized for back. In still yet another embodiment one or more sides is formed from the same piece of material as back. In this embodiment back, and one or more sides are manufactured from one single, continuous piece of material and subsequently adhered to front. In this embodiment a separate card is utilized for front.

As shown in FIGS. 7, 8, and 9 male locking tab(s) 32 are designed to reside in female locking slot 30. In one embodiment, tab(s) being designed in a manner that allows attachment or securing to receptacle, yet provide enough maneuverability and pliability to easily remove the product by deconstructing one or more sides. In one embodiment, tab(s) are from the same continuous piece of materials as front and one or more sides.

FIG. 1 further details front 4, back 8, and one or more sides 10. In one embodiment there are layered aspects of same. In a standard use such as in a retail store, multiple layers are adhered/affixed/bonded to one another. In one embodiment, front is secured directly to back via a securing means such as, but not limited to glue, adhesive, heat activated adhesive, pressure activated adhesive, releaseable adhesive, or pressure. Releaseable adhesive is defined as an adhesive means which releases, leaving behind minimal traces of the adhesive upon one surface. Alternative methods of sealing include both Press Seal and Heat Seal Coating (both processes utilized by CardPak).

In one embodiment, the outermost edges of front and back are approximately the same size and shape to allow package to maintain a neat and professional appearance. A blister flange can be found on the outer edges of middle. Blister flange being used to adhere and secure middle. Front and back are both slightly larger than the outermost edges of blister flange. This setup allowing a proper seal between front and back and adequately securing blister flange. In such an embodiment front and back adhere to one another at the edges, essentially securing blister flange in between front and back and ultimately securing middle.

In one embodiment back contains a series of cutouts. Such a series of cutouts can be, but are not limited to perforations in the cardboard to allow a complete or partial detachment of the cutout portion of the cardboard. Such a cutout allowing for removal of one or more of the products contained therein. In another embodiment product portions or middle may include perforations in the plastic to allow a complete or partial detachment of the cutout portion of the plastic.

FIGS. 7, 8 and 9 detail the locking and/or securing aspect described previously on the one or more sides as locking tabs. The exact location of tab(s) or slot(s) can be altered, reversed or moved according the product being displayed/sold. Various embodiments are possible which utilize different locking mechanisms that allow a proper securing. The locking mechanism may vary and take different forms based on the needs and requirements of the individual user. The ultimate purpose of the locking mechanism being to secure or close the package to allow display in an independent and/or vertical manner.

FIG. 10 details the package in a display tray. Package 2 can be arranged in a display tray 34. Such a display tray 34 is used at warehouse stores and other locations where package 2 is shipped in bulk and the retailer has the option of removing package 2 from display tray 34 or moving display tray 34 with package(s) 2 onto the shelves as a unit. Display tray 34 optionally having slots or slotted means for securing package(s) 2 in place. Alternatively package 2 interchangeable with package 24 or package 28 in display tray 34.

In one embodiment package contains two significant parts, the card stock referred to as front, back and one or more sides and the middle. Middle including both the blister flange and the product portions. In one embodiment front is directly bonded to back. This arrangement essentially locks in or secures blister flange.

In another embodiment front is able to seal at one or more points to back. This sealing being a glue, an adhesive, a heat activated adhesive, a pressure activated adhesive, pressure or any other suitable adhering means. Alternative methods of sealing include both Press Seal and Heat Seal Coating (both CardPak processes).

In order to increase the stiffness of package, a corrugated plastic insert may be used. Corrugated plastic insert providing substantial strength/stiffening to front and back. The corrugated plastic insert also providing additional tamper and pilfer resistance aspects to package. The corrugated aspects of corrugated plastic insert can be, but are not limited to a series of ribs which are semi-circular, a triangular aspect, a rectangular aspect, a cross hatched pattern, a fluted aspect, or any other suitable arrangement which adds stiffness/strength to this area. In one embodiment, the corrugated portion runs to plastic insert edges. Corrugated plastic insert can be included as a separate insert or can incorporate the corrugated aspects into blister flange. Such a one piece corrugated plastic insert being incorporated into the molding process of middle, including specifically, blister flange to provide a one piece plastic product providing the beneficial aspects of both corrugated plastic insert and blister flange. In another embodiment, a corrugated paper insert may be used. Corrugated paper insert providing substantial strength/stiffening to front and back.

In one embodiment, corrugated plastic insert being slightly smaller than the dimension of front and back, allowing for proper sealing between card front and card back. As stated previous the use of void spaces is also possible to effectuate proper adhesion. Finally, the use of corrugated plastic inserts allowing for complete recycling of the paper portions and plastic portions of package.

The size aspects of the middle and/or the corrugated plastic insert or any combination thereof are important. In order to properly place product these inserts/portions must be properly sized. One such embodiment involves using a middle and/or corrugated plastic insert which are nearly the same size as front and back, with middle and/or corrugated plastic insert being slightly smaller to allow a seal between front and back. Using a middle and/or a corrugated plastic insert nearly the same size as front and back allows for optimal product placement as product has less ability to move around as product portions are properly positioned between the at least two cards. Middle and/or corrugated plastic insert providing additional tamper resistance and reducing potential pilfering of the package.

Although some of the features and concepts of the invention have been described in detail with particular reference to certain embodiments detailed herein, other embodiments which are within the scope of the invention can achieve the same results. Variations and modifications of the present invention which may be made by those skilled in the art are within the scope of the invention as defined by the claims and equivalents thereof.

What is claimed is:

1. A package with structural integrity to stand independently comprising:

a front;

a back;

a first folded side that is folded, at a first cutout portion located within the first folded side, into an I-shape that protrudes beyond the front and the back;

a second folded side that is folded, at a second cutout portion located within the second folded side, into an I-shape that protrudes beyond the front and the back; and a blister between the front, back, first folded and second folded sides to hold product; and wherein the front, the back, the first folded and the second folded sides together form a package having a base made from the same material as the front or back, wherein the base permits the package to stand independently.

2. The package of claim 1 where the front is in direct contact with the back and is secured by an adhering means.

3. The package of claim 1 wherein the front has an opening to allow the blister to protrude there through.

4. The package of claim 3 wherein the back has an opening to allow the blister to protrude there through.

5. The package of claim 1 wherein the front is in direct contact with back, is secured by an adhering means which further secures the blister.

6. The package of claim 1 wherein the back, the first folded side and the second folded side are formed from the same continuous piece of material.

7. The package of claim 1 wherein the front, the first folded side and the second folded side are formed from the same continuous piece of material.

8. The package of claim 1 wherein the front, the back, the first folded side and the second folded side are formed from the same continuous piece of material.

9. A package with structural integrity to stand in a low profile display tray comprising:

a front;

a back;

a first folded side that is folded, at a first cutout portion located within the first folded side, into an I-shape that protrudes beyond the front and the back;

a second folded side that is folded, at a second cutout portion located within the second folded side, into an I-shape that protrudes beyond the front and the back;

a blister between the front, back, first folded and second folded sides to hold products; and wherein the front, the back, the first folded and the second folded sides together form a package having a base made from the same material as the front or back, wherein the base permits the package to stand independently.

10. The package of claim 9 wherein the front is in direct contact with the back, is secured by an adhering means which further secures the blister.

11. The package of claim 9 wherein the back, the first folded and the second folded sides are formed from the same continuous piece of material.

12. The package of claim 9 wherein the front, the first folded and the second folded sides are formed from the same continuous piece of material.

13. The package of claim 9 wherein the front, back, first folded and second folded sides are formed from the same continuous piece of material.

* * * * *